US008403113B2

(12) United States Patent
Takeuchi

(10) Patent No.: US 8,403,113 B2
(45) Date of Patent: Mar. 26, 2013

(54) DESTINATION FLOOR INDICATION DEVICE OF ELEVATOR

(75) Inventor: Nobukazu Takeuchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 260 days.

(21) Appl. No.: 12/937,475

(22) PCT Filed: Jul. 2, 2008

(86) PCT No.: PCT/JP2008/061966

§ 371 (c)(1),
(2), (4) Date: Oct. 12, 2010

(87) PCT Pub. No.: WO2010/001466

PCT Pub. Date: Jan. 7, 2010

(65) Prior Publication Data

US 2011/0031071 A1 Feb. 10, 2011

(51) Int. Cl.
*B66B 1/34* (2006.01)

(52) U.S. Cl. ..... 187/396; 187/391

(58) Field of Classification Search ..... 187/247, 187/391–396

See application file for complete search history.

(56) References Cited

U.S. PATENT DOCUMENTS

| | | | | |
|---|---|---|---|---|
| 4,749,062 | A | 6/1988 | Tsuji et al. | |
| 6,550,587 | B1 * | 4/2003 | Yuasa et al. | 187/394 |
| 6,997,288 | B2 * | 2/2006 | Kakko et al. | 187/391 |
| 7,036,635 | B2 * | 5/2006 | Rintala et al. | 187/396 |
| 7,040,459 | B2 * | 5/2006 | Matsuda et al. | 187/391 |
| 7,207,422 | B2 * | 4/2007 | Takeuchi | 187/391 |
| 7,404,469 | B2 * | 7/2008 | Takeuchi | 187/391 |
| 7,469,772 | B2 * | 12/2008 | Takeuchi | 187/396 |

(Continued)

FOREIGN PATENT DOCUMENTS

| | | |
|---|---|---|
| CN | 1780778 A | 5/2006 |
| JP | 6 15394 | 3/1994 |

(Continued)

OTHER PUBLICATIONS

International Search Report issued Mar. 31, 2009 in PCT/JP08/061966 filed Jul. 2, 2008.

Office Action issued Jan. 5, 2012 in Korean Patent Application No. 10-2010-7022709 (with English translation).

(Continued)

*Primary Examiner* — Anthony Salata

(74) *Attorney, Agent, or Firm* — Oblon, Spivak, McClelland, Maier & Neustadt, L.L.P.

(57) ABSTRACT

Provided is a destination floor indication device of an elevator which is excellent in the viewability of destination floor indications and can rapidly indicate destination floors. For this purpose, the destination floor indication device of an elevator includes an indication device provided in at least either a hall or a car of an elevator; an indication information storage device which stores the maximum number of indications of destination floors which are caused to be indicated simultaneously on one screen of the indication device, the maximum number of indications being larger than 1; and an indication controller which causes destination floors to be indicated simultaneously on the indication device when the number of destination floors caused to be indicated on the indication device is smaller than the maximum number of indications, and which divides destination floors into a number smaller than the maximum number of indications and causes the destination floors to be indicated on the indication device in a switching manner when the number of destination floors caused to be indicated on the indication device is larger than the maximum number of indications.

6 Claims, 3 Drawing Sheets

U.S. PATENT DOCUMENTS

| | | | | |
|---|---|---|---|---|
| 7,591,348 | B2 * | 9/2009 | Takeuchi | 187/391 |
| 8,157,059 | B2 * | 4/2012 | Takeuchi et al. | 187/396 |
| 2006/0207836 | A1 | 9/2006 | Takeuchi | |

FOREIGN PATENT DOCUMENTS

| | | |
|---|---|---|
| JP | 8 59108 | 3/1996 |
| JP | 2510746 | 6/1996 |
| WO | 2005 105643 | 11/2005 |

OTHER PUBLICATIONS

Chinese Office Action for Chinese Application No. 200880128952.4 dated Jul. 26, 2012, with English translation.

Office Action (with English translation) issued on Aug. 24, 2012, in counterpart Korean Appln No. 10-2010-7022709 (6 pages).

Office Action mailed Jan. 22, 2013 in Japanese Patent Application 2010-518852 (with partial English translation).

* cited by examiner

DESTINATION FLOOR INDICATION DEVICE OF ELEVATOR

TECHNICAL FIELD

The present invention relates to a destination floor indication device of an elevator.

BACKGROUND ART

In conventional destination floor indication devices of an elevator, all floors that can become destination floors are lamp-indicated in fixed positions (refer to, for example, Patent Document 1).

In other conventional indication devices of an elevator, all characters are indicated when the number of characters is smaller than a maximum number of indications determined beforehand. On the other hand, all characters are scroll-indicated when the number of characters is larger than the maximum number of indications determined beforehand (refer to, for example, Patent Document 2).

Patent Document 1: Japanese Patent No. 2510746

Patent Document 2: Japanese Patent Publication No. 6-15394

DISCLOSURE OF THE INVENTION

Problems to be Solved by the Invention

However, in the destination floor indication device of an elevator described in Patent Document 1, the size of each destination floor indication is small when the number of floors of a building is large. For this reason, this destination floor indication device of an elevator had the problem that the viewability is low for users having poor eyesight.

On the other hand, when destination floors are indicated by using the destination floor indication device of an elevator described in Patent Document 2, it becomes easier for users to perceive their destination floors. However, in the case of a large number of registered destination floors, it was necessary to wait until desired destination floors are scroll-indicated.

The present invention has been made in order to solve the problem described above, and the object of the invention is to provide a destination floor indication device of an elevator which is excellent in the viewability of destination floor indications and can quickly indicate destination floors.

Means for Solving the Problems

A destination floor indication device of an elevator includes an indication device provided in at least either a hall or a car of an elevator; an indication information storage device which stores a maximum number of indications of destination floors which are caused to be indicated simultaneously on one screen of the indication device, the maximum number of indications being larger than 1; and an indication controller which causes destination floors to be indicated simultaneously on the indication device when the number of destination floors caused to be indicated on the indication device is smaller than the maximum number of indications, and which divides destination floors into a number smaller than the maximum number of indications and causes the destination floors to be indicated on the indication device in a switching manner when the number of destination floors caused to be indicated on the indication device is larger than the maximum number of indications.

Advantage of the Invention

According to the present invention, there is provided a destination floor indication device of an elevator which is excellent in the viewability of destination floor indications and can quickly indicate destination floors.

DESCRIPTION OF SYMBOLS

1 elevator controller, 2 communication channel,

3 destination floor indication device, 4 indication section,

5 communication section, 6 microcomputer, 7 memory section,

8 indication information storage section, 9 indication control section,

10 message, 11 ordinary indication, 12 enlarged indication,

13 indication with extinguished lamp, 14 indication in changed colors

BEST METHOD FOR CARRYING OUT THE INVENTION

The best mode for carrying out the present invention will be described with reference to the accompanying drawings. Incidentally, in each of the drawings, like numerals refer to like or corresponding parts and overlaps of description of these parts are appropriately simplified or omitted.

Embodiment 1

Figure 1:
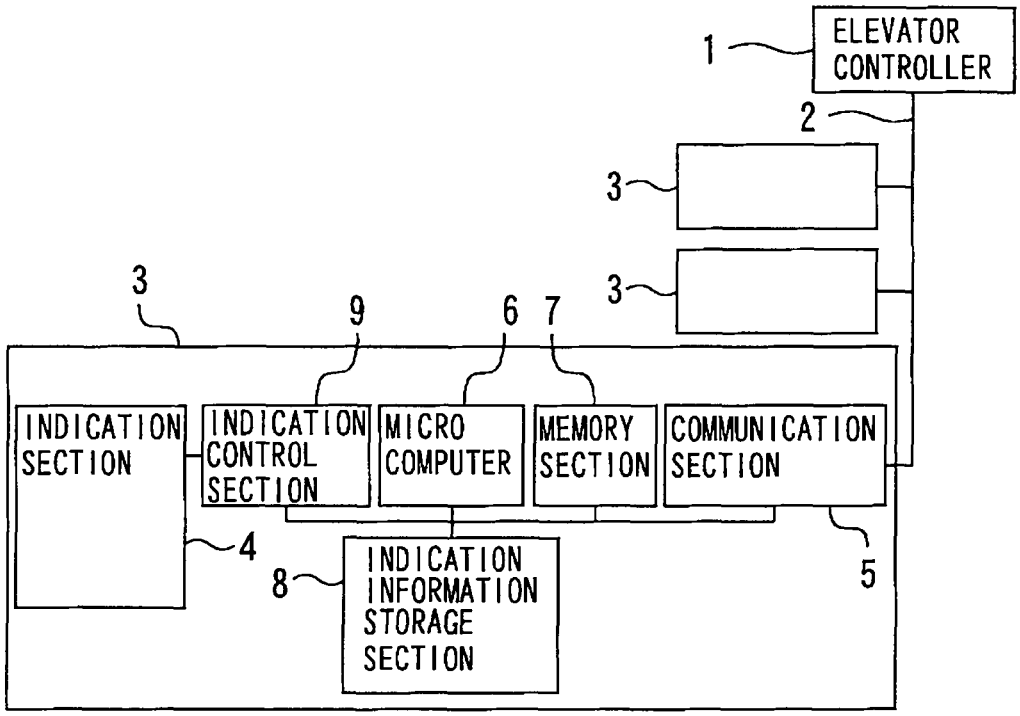
FIG. 1 is a general block diagram of a destination floor indication device of an elevator in Embodiment 1 of the present invention.

FIG. 1 is a general block diagram of a destination floor indication device of an elevator in Embodiment 1 of the present invention.

In FIG. 1, reference numeral 1 denotes an elevator controller. This elevator controller 1 is connected to a destination floor indication device 3 via a communication channel 2. This destination floor indication device 3 is provided in a hall or a car of an elevator in quantities of at least one. This destination floor indication device 3 is provided with an indication section 4, a communication section 5, a microcomputer 6, a memory section 7, an indication information storage section 8 and an indication control section 9.

The indication section 4 is composed of an indication device, such as a liquid crystal display, a plasma display, an LED or a cathode-ray tube. The communication section 5 controls the communication channel 2. The microcomputer 6 controls the whole destination floor indication device 3. The memory section 7 is composed of a memory section for program storage and a work memory section. The memory section for program storage stores indication control programs. The work memory section reserves a work area for executing the indication control programs.

The indication information storage section 8 stores indication information about characters and graphics of destination floors indicated in the indication section 4. Also, the indication information storage section 8 stores a maximum number of indications of destination floors which are caused to be indicated simultaneously on one screen of the indication section 4; this maximum number of indications is larger than 1. That is, the indication information storage section 8 functions as a storage device which stores various kinds of information necessary for destination floor indications. The indication control section 9 controls screen indications of the indication section 4 under instructions from the microcomputer 6. That is, the indication control section 9 functions as a controller which controls destination floor indications.

Incidentally, the indication information storage section 8 and the memory section 7 are composed of a memory device, such as a hard disk drive, a nonvolatile memory and a dynamic random access memory. The indication information storage section 8 and the memory section 7 may sometimes be built into the microcomputer 6.

In the destination floor indication device 3 of this configuration, destination floor information is sent from the elevator controller 1 to the microcomputer 6 via the communication channel 2 and the communication section 5. On receiving the destination floor information, the microcomputer 6 acts on the basis of an indication control program while using the work memory section. Concretely, the microcomputer 6 takes indication information responsive to the destination floor information from the indication information storage section 8 and sends the indication information to the indication control section 9. The indication control section 9 causes the indication section 4 to indicate destination floors on the basis of the indication information in question.

At this time, when the number of destination floors which the indication section 4 is caused to indicate is smaller than the maximum number of indications, the indication control section 9 causes the destination floors to be indicated simultaneously on the indication section 4. On the other hand, when the number of destination floors which the indication section 4 is caused to indicate is larger than the maximum number of indications, the indication control section 9 divides the destination floors into a number which is smaller than the number of maximum indications, and causes the destination floors to be indicated on the indication section 4 in a switching manner.

Next, a detailed example of a destination floor indication performed by the destination floor indication device 3 will be given.

Figure 2:
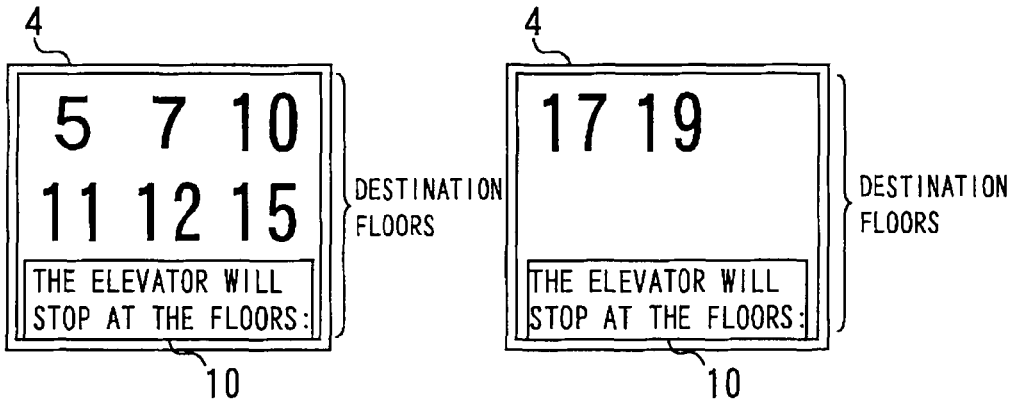
FIG. 2 is a diagram showing a screen indicated by the destination floor indication device of an elevator in Embodiment 1 of the present invention.

FIG. 2 is a diagram showing a screen indicated by the destination floor indication device of an elevator in Embodiment 1 of the present invention.

In FIG. 2, the message 10 "THE ELEVATOR WILL STOP AT THE FLOORS:" is indicated as a still image in the lower part of the screen of the indication section 4. This indication may show other words and may not be a still image. And the indication control section 9 creates a destination floor indication arrangement, which is the arrangement of destination floors, from the destination floor information. It is supposed that the number 6 is set as the maximum number of indications in the indication information storage section 8. In this case, it is possible to indicate up to six destination floors on the indication section 4.

For this reason, for example, in the case of eight destination floors of the 5th floor, the 7th floor, the 10th floor, the 11th floor, the 12th floor, the 15th floor, the 17th floor and the 19th floor, 8÷6=1.333 and the destination floors are divided into two screens. And the indication positions of the destination floors in the indication section 4 are calculated from the number of necessary screens and the number of destination floors per screen. And a screen containing the nearest floor in the traveling direction of the elevator is indicated for a given time. More concretely, destination floors for one screen from the nearest destination floor in the traveling direction of the elevator are indicated in the indication section 4.

First, the 5th floor, the 7th floor, the 10th floor, the 11th floor, the 12th floor and the 15th floor are indicated. Concretely, the 5th floor, the 7th floor and the 10th floor are indicated in the upper area of the indication section 4, and the 11th floor, the 12th floor and the 15th floor are indicated in the lower area of the indication section 4. After that, the screen of the indication section 4 switches and the 17th floor and the 19th floor are indicated. Concretely, the 17th floor is indicated on the left side of the upper area of the indication section 4, and the 19th floor is indicated in the middle of the upper area of the indication section 4. Incidentally, these indication positions are not especially limited.

For example, the indication positions may be horizontally centered or they may be vertically centered. Concretely, it may be ensured that when the 5th floor is first registered as a destination floor, the 5th floor is indicated in the middle of the indication section 4. It may be ensured that when the 10th floor is then registered as a destination floor, the 5th floor and the 10th floor are indicated in the middle of the indication section 4. It may be ensured that when the 7th floor is then registered as a destination floor, the floors are indicated in the middle of the indication section 4 in the order of the 5th floor, the 7th floor and the 10th floor.

Next, an example of the operation of the destination floor indication device 3 will be described with the aid of FIG. 3.

Figure 3:
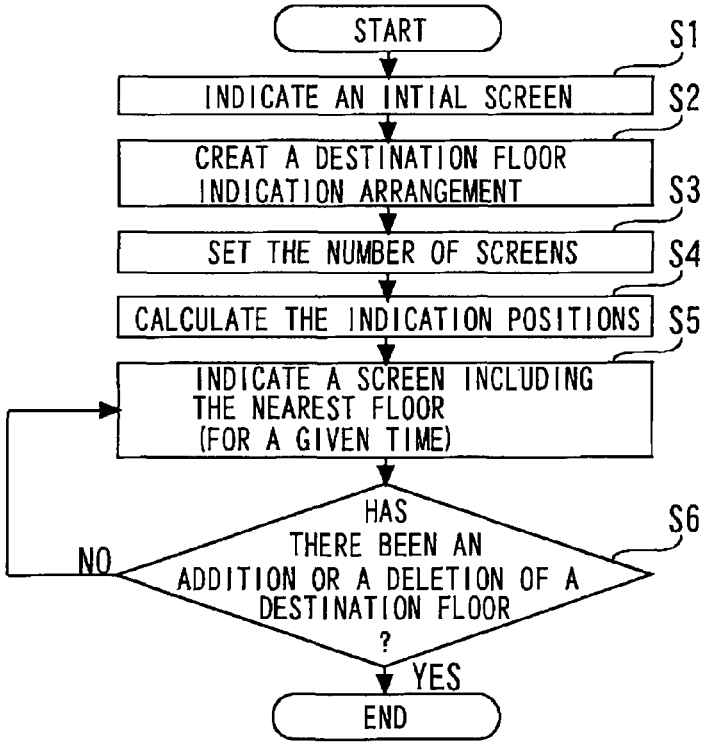
FIG. 3 is a flowchart showing the operation of the destination floor indication device of an elevator in Embodiment 1 of the present invention expected when this destination floor indication device indicates destination floors.

FIG. 3 is a flowchart showing the operation of the destination floor indication device of an elevator in Embodiment 1 of the present invention expected when this destination floor indication device indicates destination floors.

First, in Step S1, an initial screen of a background screen, the message 10 and the like is indicated in the indication section 4, and the operation proceeds to Step S2. In Step S2, a destination floor indication arrangement is created, and the operation proceeds to Step S3. In Step S3, the number of screens is set from destination floor information, and the operation proceeds to Step S4.

In Step S4, the indication positions of the destination floors are calculated, and the operation proceeds to Step S5. In Step S5, a screen including the nearest floor is indicated for a given time, and the operation proceeds to Step S6. In Step S6, a judgment is made as to whether there has been an addition or a deletion of a destination floor. And when there has been no addition or the like of a destination floor, the operation proceeds to Step S5, and a display is performed in a switching manner. On the other hand, when there has been an addition or the like of a destination floor, the operation of the destination floor indication device 3 is finished, and the operation returns to START again. And a screen containing a destination floor in the vicinity of the present floor in the traveling direction of the elevator is indicated, and the above-described operation is repeated.

According to Embodiment 1 described above, when the number of destination floors is smaller than the maximum number of indications, the destination floors are indicated simultaneously on the indication section 4. On the other hand, when the number of destination floors is larger than the maximum number of indications, the destination floors are divided into a number smaller than the maximum number of indications and are indicated in a switching manner on the indication section 4. For this reason, it is possible to indicate destination floors in appropriate sizes on a still screen.

Even when the number of destination floors is large and not all the destination floors are capable of indication on the indication section 4, it is possible to indicate the destination floors quickly and without omission by switching the screen sequentially. During a normal indication, destination floors for one screen from the nearest destination floor in the traveling direction of the elevator are indicated on the indication section 4. For this reason, it becomes easier for the user to perceive a floor at which the elevator is going to stop, for a while.

Embodiment 2

Figure 4:
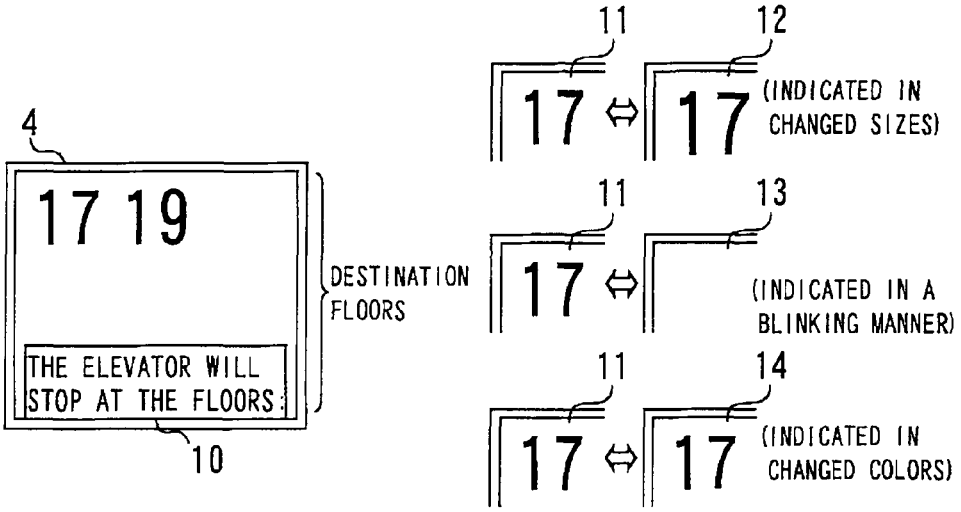
FIG. 4 is a diagram showing a screen indicated by a destination floor indication device of an elevator in Embodiment 2 of the present invention.

FIG. 4 is a diagram showing a screen indicated by a destination floor indication device of an elevator in Embodiment 2 of the present invention. Incidentally, like numerals refer to like or corresponding parts in Embodiment 1 and descriptions of these parts are omitted.

In Embodiment 2, a function that causes a destination floor at which a car has arrived and an added destination floor to be indicated in a manner permitting easy perception is added to the indication control section 9 of Embodiment 1. Hereinafter, a detailed example of destination floor indications peculiar to Embodiment 2 will be given.

The upper right-side area of FIG. 4 shows a case where a destination floor at which the car has arrived or an added destination floor is indicated in changed sizes. Concretely, a switchover between an ordinary indication 11 and an enlarged indication 12 of the 17th floor is repeated for a given time (for example, three seconds). The middle right-side area of FIG. 4 shows a case where a destination floor at which the car has arrived or an added destination floor is indicated in a blinking manner. Concretely, a switchover between the ordinary indication 11 and an indication with extinguished lamp 13 of the 17th floor is repeated for a given time.

The lower right-side area of FIG. 4 shows a case where a destination floor at which the car has arrived or an added destination floor is indicated in changed colors. Concretely, a switchover between the ordinary indication 11 and an indication in changed colors 14 of the 17th floor is repeated for a given time. Incidentally, it may be ensured that the enlarged indication 12, the indication with extinguished lamp 13 and the indication in changed colors 14 a destination floor at which the car has arrived or an added destination floor, for a given time.

Figure 5:
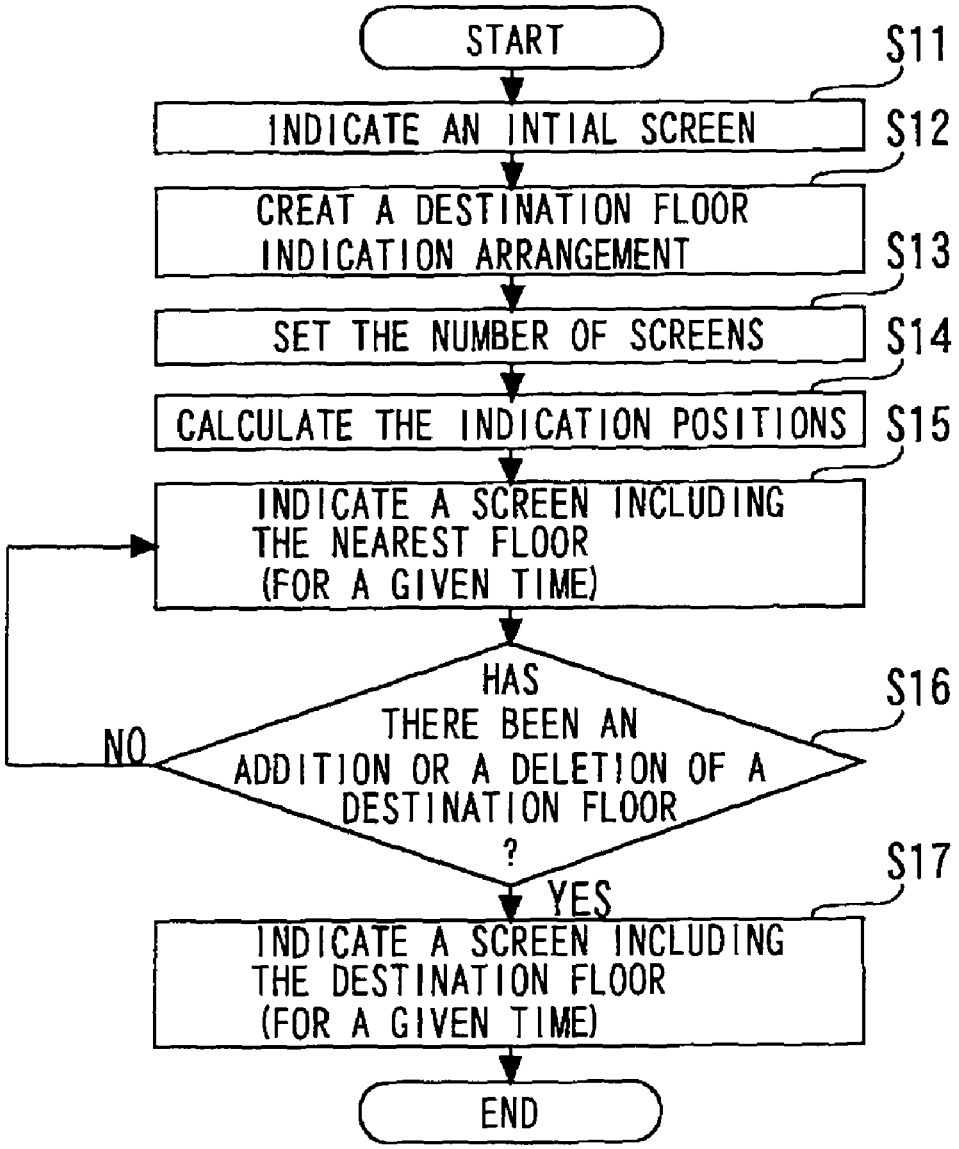
FIG. 5 is a flowchart showing the operation of the destination floor indication device of an elevator in Embodiment 2 of the present invention expected when this destination floor indication device indicates destination floors.

FIG. 5 is a flowchart showing the operation of the destination floor indication device of an elevator in Embodiment 2 of the present invention expected when this destination floor indication device indicates destination floors.

Because the operations in Steps S11 to S16 are the same as those in Steps S1 to S6 of FIG. 3 in the Embodiment 1, the descriptions thereof are omitted.

In Embodiment 2, in Step S16, when there is a destination floor at which the car has arrived or an added destination floor, the operation proceeds to Step S17. In Step S17, a screen including a destination floor at which a car has arrived or an added destination floor is indicated. And a destination floor at which a car has arrived or an added destination floor is indicated by a method different from the ordinary indication 11 for a given time. After that, the operation of the destination floor indication device 3 is finished, and the operation returns to START.

According to Embodiment 2 described above, one screen including a destination floor at which a car has arrived or an added destination floor is indicated on the indication section 4 for a given time. For this reason, it becomes easier for the user to perceive a destination floor at which a car has arrived or an added destination floor. Also a destination floor at which a car has arrived or an added destination floor is indicated on the indication section 4 by a method different from the ordinary indication 11. For this reason, it becomes easier for the user to perceive a destination floor at which a car has arrived or an added destination floor.

INDUSTRIAL APPLICABILITY

As described above, the destination floor indication device of an elevator in the present invention can be applied to an elevator in which a destination floor indication device is provided in a hall or a car of the elevator.

The invention claimed is:

1. A destination floor indication device of an elevator, comprising:

an indication device provided in at least either a hall or a car of an elevator;

an indication information storage device which stores a maximum number of indications of destination floors which are caused to be indicated simultaneously on one screen of the indication device, the maximum number of indications being larger than 1; and an indication controller which causes destination floors to be indicated simultaneously on the indication device when the number of destination floors caused to be indicated on the indication device is smaller than the maximum number of indications, and which divides destination floors into a number smaller than the maximum number of indications and causes the destination floors to be indicated on the indication device in a switching manner when the number of destination floors caused to be indicated on the indication device is larger than the maximum number of indications.

2. The destination floor indication device of an elevator according to claim 1, wherein the indication controller causes, during a normal indication, destination floors for one screen from the nearest destination floor in the traveling direction of the elevator to be indicated on the indication device, and causes, during a destination floor addition, one screen including an added destination floor, to be indicated on the indication device for a given time.

3. The destination floor indication device of an elevator according to claim 2, wherein the indication controller causes, during the given time, the indication device to indicate the added destination floor by a method different from an ordinary indication.

4. The destination floor indication device of an elevator according to claim 1, wherein the indication controller causes the indication device to indicate a destination floor at which the car has arrived by a method different from an ordinary indication when the car has arrived at the destination floor.

5. The destination floor indication device of an elevator according to claim 2, wherein the indication controller causes the indication device to indicate a destination floor at which the car has arrived by a method different from an ordinary indication when the car has arrived at the destination floor.

6. The destination floor indication device of an elevator according to claim 3, wherein the indication controller causes the indication device to indicate a destination floor at which the car has arrived by a method different from an ordinary indication when the car has arrived at the destination floor.

* * * * *